US005301762A

United States Patent [19]

Besson

[11] Patent Number: 5,301,762

[45] Date of Patent: Apr. 12, 1994

[54] DRILLING TOOLFITTED WITH SELF-SHARPENING CUTTING EDGES

[75] Inventor: Alain Besson, Sartrouville, France

[73] Assignee: Total, Puteaux, France

[21] Appl. No.: 30,109

[22] PCT Filed: Sep. 12, 1991

[86] PCT No.: PCT/FR91/00720

§ 371 Date: Mar. 12, 1993

§ 102(e) Date: Mar. 12, 1993

[87] PCT Pub. No.: WO92/05335

PCT Pub. Date: Apr. 2, 1992

[30] Foreign Application Priority Data

Sep. 14, 1990 [FR] France ..... 90 11386

[51] Int. Cl.[5] ..... E21B 10/46; E21B 10/62; E21B 10/56

[52] U.S. Cl. ..... 175/379; 175/430; 175/432; 175/434

[58] Field of Search ..... 175/379, 434, 430, 432; 299/79, 94

[56] References Cited

U.S. PATENT DOCUMENTS

| | | | |
|---|---|---|---|
| 3,882,749 | 5/1975 | Tourek | 175/379 X |
| 4,200,159 | 4/1980 | Peschel et al. | 175/432 X |
| 4,227,106 | 7/1981 | Sahley | 299/79 |
| 4,324,300 | 4/1982 | Logan, Jr. | 175/379 |
| 4,629,373 | 12/1986 | Hall | 407/118 |
| 4,784,023 | 11/1988 | Dennis | 175/434 |
| 4,844,185 | 7/1989 | Newton, Jr. et al. | 175/434 |
| 4,869,330 | 9/1989 | Tibbitts | 175/393 |
| 4,898,252 | 2/1990 | Barr | 175/379 |

FOREIGN PATENT DOCUMENTS

| | | |
|---|---|---|
| 0363313 | 4/1990 | European Pat. Off. . |
| 2055411 | 3/1981 | United Kingdom . |

*Primary Examiner*—Stephen J. Novosad
*Attorney, Agent, or Firm*—Sughrue, Mion, Zinn, Macpeak and Seas

[57] ABSTRACT

Self-shaping disk-shaped cutting edge of a drilling tool, comprising an outer diamond-impregnated polycrystalline layer (22) applied onto a tungsten carbide layer (24), each cutting edge being mounted on a support (18) which is integral with the body (12) of the drilling tool. The cutting edge and/or its support (18) have areas (26) of least resistance, such as grooves, which are likely to cause successive fractures, thereby forming an acute relief angle (α) with the rock to be drilled (28).

9 Claims, 2 Drawing Sheets

DRILLING TOOLFITTED WITH SELF-SHARPENING CUTTING EDGES

The present invention concerns an oil or mining drilling too. The base may be a base mounted in the body of the tool, or on a tungsten carbide matrix.

A tool of this kind is disclosed in U.S. Pat. No. US-A-4 844 185. However, the use of a tool of this kind in the difficult conditions prevailing in oil or mine drilling can destroy the cutting edges, by normal wear, by impact subsequent to excess loads, or again, by excessive heating.

When the cutting edges become worn, the surface area in contact with the rock to be drilled is appreciably reduced. To preserve a certain level of effectiveness, greater force must be applied to the tool; there then arises, however, the risk of causing fracture of the cutting edges, as a result of excess load. The fracture is often clean and runs in quite random directions, which may be either advantageous or, to the contrary, harmful. The fracture is advantageously oriented when it originates in the area located just behind the polycrystalline diamond-impregnated layer, in relation to the direction of advance of the cutting edge, and when it forms an acute clearance angle with the surface of the rock formation.

Furthermore, the increased force applied to the tool may cause partial destruction or loss of the cutting edges, through heating.

Patent Nos. U.S. application No. 4 277 106 and GB-A-2055411 disclose a tool fitted with cutting edges comprising hard areas alternating with areas of lesser hardness.

Patent No. EP-A-0 363 313 describes a tool incorporating areas of fracture formed on elements which, by breaking off, allow enlargement of openings for the circulation of a liquid lubricant.

However, none of these patents allows solution of the aforementioned problem, which is that of the fracture of the cutting edges along surfaces whose orientations are advantageous. The present invention is intended to surmount these difficulties by proposing self-sharpening cutting edges, i.e., they can be broken off along surfaces having advantageous orientations, every time that the force applied to the tool exceeds a given threshold.

To this end, the invention relates to a drilling tool of the type specified above and characterized by the fact that the cutting edge and/or its base has formed on it zones of least resistance, such as grooves, which may initiate successive fractures forming an acute angle of clearance with the rock formation to be drilled.

The clearance angle is preferably between 25° and 55°.

Other features and advantages of the invention will emerge from the following description, provided with reference to the attached drawings in which.

Figure 1:
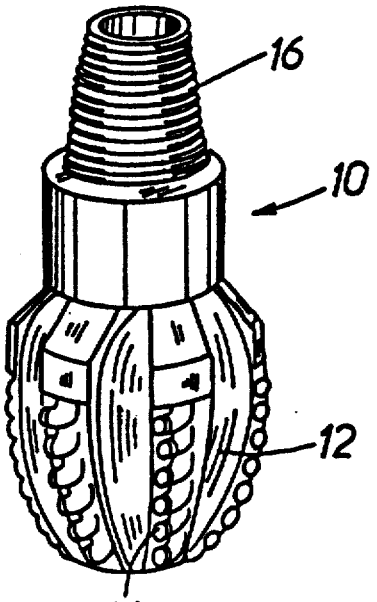
FIG. 1 is a perspective view of a conventional drilling tool.

With reference to FIG. 1, the tool 10 incorporates a steel body 12 supporting, on its lateral wall, a multiplicity of cutting edges 14 arranged in several rows. The tool ends in a threaded portion 16 designed to connect with the rotation-drive casing (not illustrated).

Figure 2:
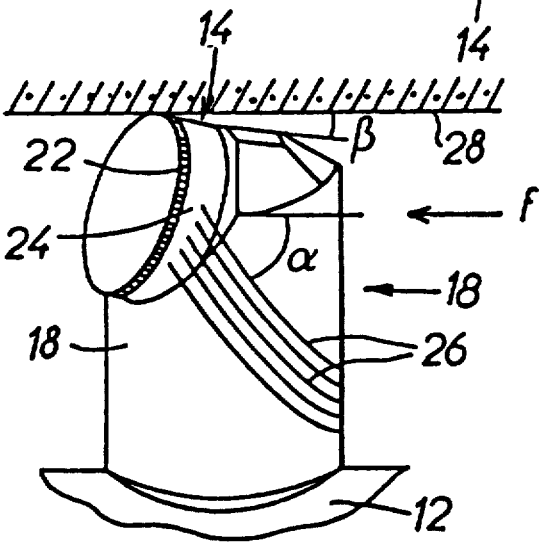
FIG. 2 is a perspective view of a cutting edge attached to a base, the groves being formed on both of these elements.

As shown in FIG. 2, each cutting edge 14 is mounted in one end of a substantially cylindrical base 18, whose other end is itself mounted on the body 12. The cutting edge is shaped like a circular plate and comprises a first polycrystalline, diamond-impregnated layer 22, which is fastened, using an appropriate bonding agent, to a second layer 24 made of tungsten carbide.

A number of grooves 26, which can be parallel to each other, are imprinted on the lateral wall of the cutting edge 14 and of the base 18. Each groove comprises two arms (of which one only is visible in FIG. 2), which extend downward from the cutting edge 14 to the base symmetrically in relation to the intermediary plane of the cutting edge, and which meet on the back of the base. Each groove thus delimits a preferred surface of fracture of the cutting edge and the base.

The cutting edge is fatigued by the choice of the orientation, the dimensions, and the positioning of the grooves. The fracture along a given surface of fracture is produced when the cutting edge has undergone a degree of wear and when a predetermined load is applied to it.

FIG. 2 illustrates a completely unworn cutting edge fastened to a base; it further shows, at reference 28, the rock formation to be drilled and, by means of arrow f, the direction of advance of the cutting edge. Initially, the upper face forms an acute, receding angle $\beta$ with the wall of the rock formation, so that only the cutting edge 14 attacks the rock. The efficacy of the cutting edge is then optimal.

Figure 3:
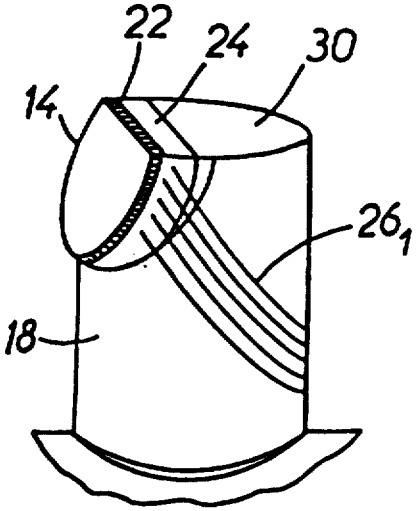
FIGS. 3 to 6 illustrate successive phases of the process for sharpening the cutting edge and base in FIG. 2.
Figure 4:
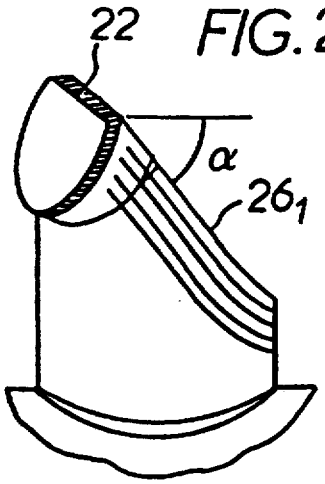

FIG. 3 shows the cutting edge and the base in a subsequent state. The entire upper part of the cutting edge and of the base has been worn away by the rock. The contact with the rock formation now occurs by means of any flat, upper surface 30. The efficacy of the cutting edge diminishes. If a greater load is applied in order to maintain the same level of effectiveness, fracture of the cutting edge and of the base is produced along the surface containing the first groove $26_1$. The cutting edge then takes on the sharpened form shown in FIG. 4. Once again, the cutting edge functions at optimal effectiveness, since it attacks the rock at an acute angle $\alpha$, which is clearly greater than the limiting angle $\beta$ indicated previously.

Figure 5:
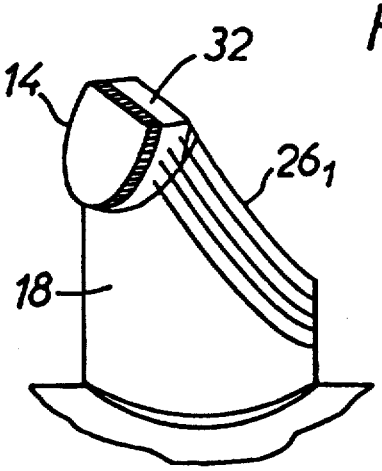
Figure 6:
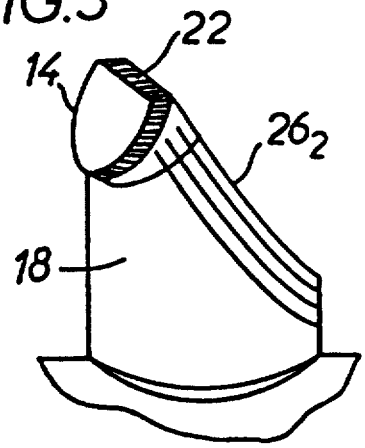

During subsequent use, the cutting edge undergoes further wear and takes on the shape illustrated in FIG. 5. A planed surface 32 is produced on it. Once again, the rock-contact surface increases and the forces applied must be intensified, thereby causing fracture of the cutting edge and of the base along the surface incorporating the second groove $26_2$. Thus, the sharpened edge in FIG. 6 is obtained.

The wearing-sharpening process continues in the same way until the last groove has been reached.

There may be any number of grooves. Only five of them have been shown as examples in FIG. 2.

The spacing and depth of the grooves can vary within broad limits, e.g., between 0.1 and 10 mm. In the embodiment in FIG. 7, all of the grooves have the same width and the same depth. However, as shown in the embodiment in FIG. 8, deep grooves **26*a* can alternate with shallower grooves 26*b***.

Figure 7:
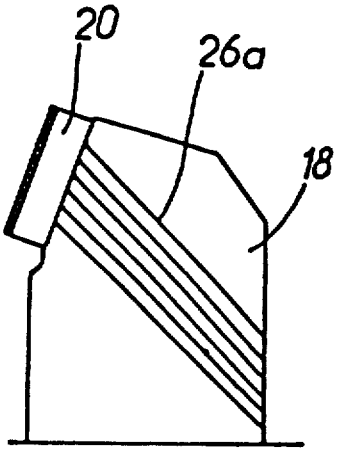
FIGS. 7 to 11 are raised views of several variants of groove formation on the cutting edge and the base.
Figure 8:
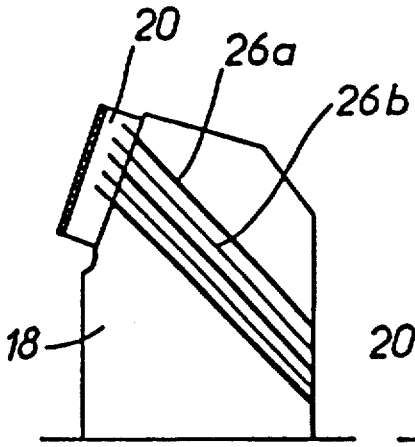

The grooves can delimit parallel flat surfaces, as shown in FIGS. 7 and 8, in which, because of perspective, only parallel rectilinear portions of the grooves can be seen.

Figure 10:
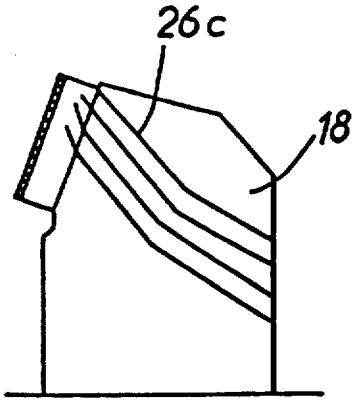

In FIG. 10, the grooves 26*c* are constituted in perspective by broken lines formed from "rectilinear" sections.

Figure 11:
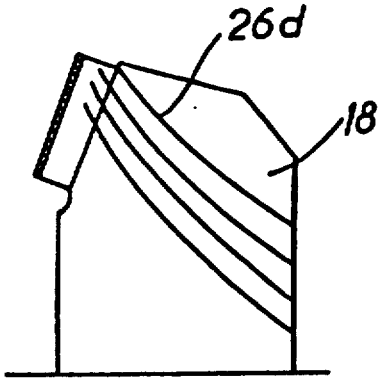

In the embodiment in FIG. 11, the grooves 26*d* are curved, so that the successive fractures are produced along concave surfaces.

Figure 9:
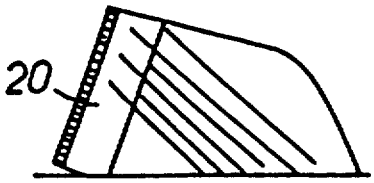

The grooves can originate on the cutting edge 14, near the crystalline diamond area (FIGS. 8, 10, and 11), on the base (FIG. 7), or in alternating fashion on the cutting edge and the base (FIG. 9).

Numerous other modifications of detail can still be made in the embodiments described. For example, grooves can be made discontinuous, as points or dashes. The grooves can run completely around the cutting edge and base, or only one part of the latter.

I claim:

1. A drilling tool (10), comprising a body (12) fitted with a plurality of bases (18), each base supporting a self-sharpening, plate-shaped cutting edge (14) comprising an outer polycrystalline, diamond-impregnated layer (22) deposited on a tungsten carbide layer (24), wherein each cutting edge 14) and/or base (18) has formed on it areas (26) of least resistance, such as grooves, which can initiate successive fractures forming an acute angle of clearance ($\alpha$) with a rock formation to be drilled (28).

2. A tool according to claim 1, wherein said angle of clearance ranges preferably between 25° and 55°.

3. A tool according to claim 1, wherein said grooves are parallel to each other.

4. A tool according to claim 1, wherein said grooves have the same width and depth.

5. A tool according to claim 1, wherein the deep grooves (26*a*) alternate with shallower grooves (26*b*).

6. A tool cutting edge according to claim 1, wherein each groove comprises two arms which descend from the cutting edge (14) to the base (18), symmetrically in relation to the intermediary plane of the cutting edge, and which meet at the back of the base.

7. A tool according to claim 1, wherein said grooves (26*a*) are rectilinear, so as to delimit flat surfaces of fracture.

8. A tool according to claim 1, wherein the grooves form broken lines (26*c*) or curved lines (26*d*), and delimit concave surfaces of fracture.

9. A tool according to claim 1, wherein said grooves are discontinuous, e.g., in the form of points or dashes.

* * * * *